US006422833B1

(12) United States Patent
Park

(10) Patent No.: US 6,422,833 B1
(45) Date of Patent: Jul. 23, 2002

(54) RESONANCE REDUCING DEVICE FOR A HERMETIC COMPRESSOR

(75) Inventor: Seong-woo Park, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/705,429

(22) Filed: Nov. 3, 2000

(30) Foreign Application Priority Data

Mar. 7, 2000 (KR) ..... 2000-11339

(51) Int. Cl.[7] ..... F04B 17/00; F04B 35/00; F04B 35/04

(52) U.S. Cl. ..... 417/363; 417/415; 417/902

(58) Field of Search ..... 417/363, 415, 417/902

(56) References Cited

U.S. PATENT DOCUMENTS 2,907,515 A * 10/1959 Davey ..... 230/58
2,929,552 A * 3/1960 Mcgregor ..... 230/235
2,965,289 A * 12/1960 Weibel, Jr. ..... 230/235
3,215,343 A * 11/1965 Gannaway ..... 230/235
3,279,683 A * 10/1966 Kleinlein ..... 230/58
3,445,059 A * 5/1969 Hannibal et al. ..... 230/235
3,509,907 A * 5/1970 Gannaway ..... 137/512
3,887,303 A * 6/1975 Matsuzaka et al. ..... 417/363
4,406,593 A * 9/1983 Kessler ..... 417/363

OTHER PUBLICATIONS

The Random House College Dictionary, Random House, Inc. Ney York, N.Y. p. 426.*

* cited by examiner

*Primary Examiner*—Charles G. Freay
*Assistant Examiner*—Timothy P. Solak
(74) *Attorney, Agent, or Firm*—Ladas & Parry

(57) ABSTRACT

A hermetic reciprocating compressor includes a crankshaft stopper with an integrally formed resonance reducer portion. The crankshaft stopper is attached to the upper inner portion of a sealed casing of a compressor to restrict the movement of a motor portion and a compression device portion. The resonance reducer portion of the crankshaft stopper increases the rigidity of the sealed casing by reducing the resonance of the sealed casing. Since the vibration produced and transmitted to the sealed casing during the operation of the compressor is absorbed or damped by the crankshaft stopper with the resonance reducer portion, the resonance of the sealed casing is reduced and/or eliminated. Accordingly, overall noise caused by resonance of the sealed casing can be reduced.

9 Claims, 4 Drawing Sheets

RESONANCE REDUCING DEVICE FOR A HERMETIC COMPRESSOR

BACKGROUND OF THE INVENTION

1. Field of the Invention

The present invention relates to a compressor and more particularly, to a hermetic reciprocating compressor for compressing and discharging refrigerant in a refrigerator or an air conditioner, etc.

2. Description of the Prior Art

Generally, as shown in FIG. 1, a conventional hermetic reciprocating compressor includes a sealed casing 10, an motor portion 20, a compression device portion 30, an elastic supporting portion 40, and a crankshaft stopper 50.

The sealed casing 10 includes upper and lower shells 11 and 12, respectively, which are substantially hemispheric in shape. The sealed casing 10 accommodates the motor portion 20, compression device portion 30, elastic supporting portion 40, and the crankshaft stopper 50.

The motor portion 20 includes a stator 21, rotor 22, and crankshaft 23. The crankshaft 23 is press-fit to the rotor 22 and includes an eccentric portion 23*a* formed on one side thereof The compression device portion 30 includes a cylinder block 31 having a compressing chamber 31*a*, a piston 32 reciprocally movable within the compressing chamber 31*a* of the cylinder block 31, and a connecting rod 33 disposed between the piston 32 and the eccentric portion 23*a* of the crankshaft 23 to transform and transmit the rotary movement of the crankshaft 23 into a linear reciprocal movement of the piston 32.

The elastic supporting portion 40 absorbs and damps various vibrations generated during operation of the compressor by elastically supporting the cylinder block 31 of the compression device portion 30 toward the lower shell 12 of the sealed casing 10. Such an elastic supporting portion 40 includes a plurality of snubbers 41 arranged on the bottom surface of the lower shell 12, a plurality of protrusions 42 protruding from the lower portion of the cylinder block 31, and a plurality of suspension springs 43 disposed between the snubbers 41 and the protrusions 42 for elastically supporting the cylinder block 31.

The motor portion 20 and the compression device portion 30 can move vertically and horizontally during conveyance of the compressor into contact with the inner wall of the sealed casing 10. The crankshaft stopper 50 restricts the movement of the motor portion 20 and the compression device portion 30, both of which are elastically and movably supported in the sealed casing 10 by the elastic supporting portion 40. The crankshaft stopper 50 is welded onto the inner upper side of the upper shell 11 and includes a movement restricting hole 51, into which an upper end of the crankshaft 23 is inserted. Since the upper end of the crankshaft 23 is received and supported in the movement restricting hole 51 of the crankshaft stopper 50, movement of the motor portion 20 and the compression device portion 30 is limited. Accordingly, possible deformation and breakage of compressor components by contact with the inner wall of the sealed casing 10 during wide horizontal and vertical movements of the electronic device portion 20 and the compression device portion 30 during the operation of the compressor are, prevented.

In the conventional hermetic reciprocating compressor such as that described above when electricity is supplied, rotary movement of the crankshaft 23 is transformed and transmitted into linear reciprocal movement of the piston 32 through the connecting rod 33. The piston 32 linearly reciprocates within the compressing chamber 31*a* of the cylinder block 31 to compress and discharge a refrigerant. The high-speed refrigerant flow and vibrations from various parts of the motor portion 20 and the compression device portion 30 inevitably produce noise. The suction and discharge mufflers 13 and 14 reduce the noise from the refrigerant flow, while the elastic supporting portion 40 absorbs and damps the vibrational noise.

In the conventional hermetic reciprocating compressor, however, the suction muffler 13, discharge muffler 14, and the elastic supporting portion 40 only reduce the noise produced during the operation of the compressor to a certain extent. The noise of the compressor remains high due to lack of structure for reducing transmission noise that is caused from the resonance of the sealed casing 10.

SUMMARY OF THE INVENTION

The present invention has been made to overcome the above-mentioned problems of the prior art, and accordingly, it is an object of the present invention to provide a hermetic reciprocating compressor for reducing the noise level of the compressor by reducing transmission noise caused by resonance of a sealed casing.

Another object of the present invention is to provide a hermetic reciprocating compressor capable of reducing the transmission noise caused by resonance of the sealed casing by making simple changes to the existing structure without changing the design of the compressor itself.

The above objects are accomplished by a hermetic reciprocating compressor according to the present invention having a resonance reducer portion integrally formed on the crankshaft stopper which is attached to the upper inner portion of the sealed casing. The resonance reducer portion of the crankshaft stopper restricts movement of motor portion and the compression device portion to increase the rigidity of the sealed casing and reduce the resonance of the sealed casing.

According to the present invention, the vibration, which is produced during the operation of the compressor and is transmitted to the sealed casing, is absorbed or damped by the resonance reducer portion of the crankshaft stopper, thereby reducing and/or preventing resonance of the sealed casing. Accordingly, transmission noise due to resonance of the sealed casing can also be reduced.

According to the preferred embodiment of the present invention, the crankshaft stopper includes a centrally formed movement restriction hole. The movement restriction hole receives the upper end of the crankshaft, the resonance reducer portion vertically bent and formed around the movement restriction hole, and at least two welding portions for connecting the crankshaft stopper.

There may be either two or four welding portions that extend vertically upward and radially outward from the movement restriction hole. Each welding portion has a plurality of embossings formed thereon.

Further, it is preferable that the crankshaft stopper with the integrally formed resonance reducer portion be attached to the upper shell of the sealed casing at an offset angle approximately of 45° from the reciprocal movement path of the piston of the compression device portion.

BRIEF DESCRIPTION OF THE DRAWINGS

The above and other objects and advantages of the present invention will become readily apparent by reference to the following detailed descriptions when considered in conjunction with the accompanying drawings in which.

DETAILED DESCRIPTION OF THE PREFERRED EMBODIMENT

Figure 1:
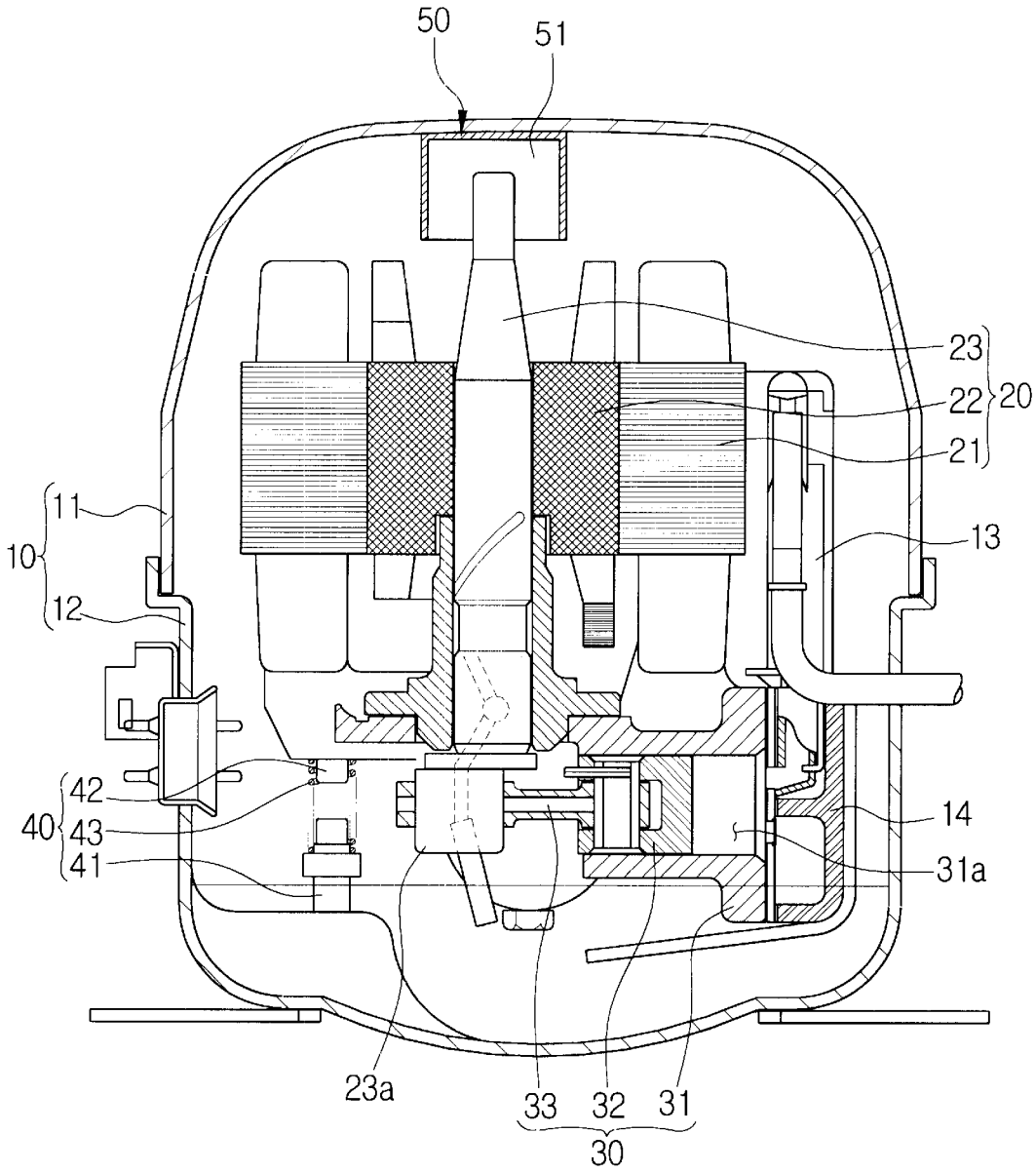
FIG. 1 (PRIOR ART)
FIG. 1 is a longitudinal sectional view for schematically showing the structure of a conventional hermetic reciprocating compressor.

The preferred embodiment of the present invention will be described below, while the like reference numerals refer to the same elements throughout the description for an easier explanation.

Figure 2:
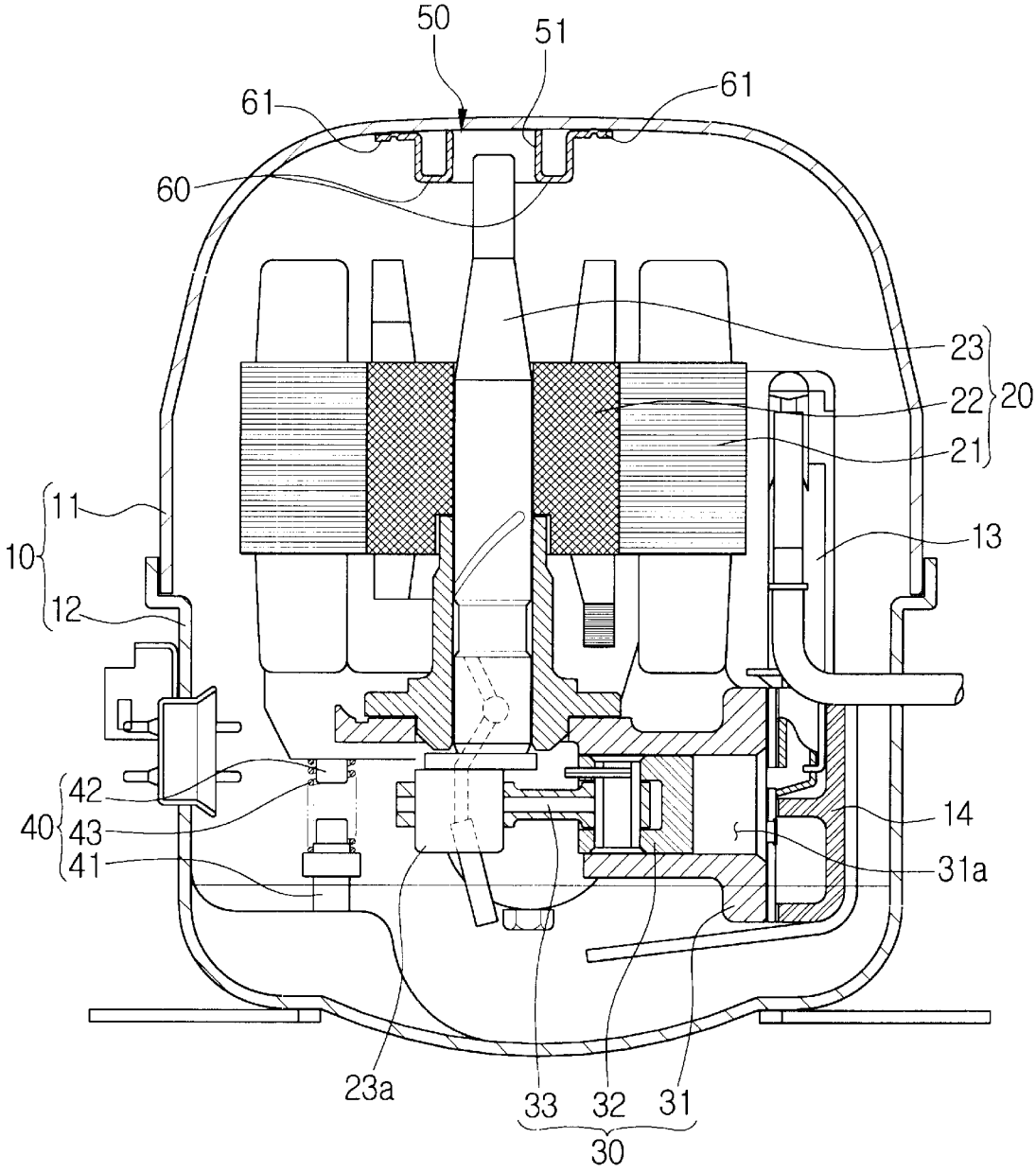
FIG. 2 is a longitudinal sectional view for schematically showing the structure of a hermetic reciprocating compressor according to the preferred embodiment of the present invention.

As shown in FIG. 2, the hermetic reciprocating compressor according to the preferred embodiment of the present invention includes a sealed casing 10, a motor portion 20, a compression device portion 30, an elastic supporting portion 40, a crankshaft stopper 50, and a resonance reducer portion 60 for increasing rigidity of the sealed casing 10.

The sealed casing 10 includes upper and lower shells 11 and 12 which are substantially hemispheric in shape. The sealed casing houses the electronic device portion 20, compression device portion 30, elastic supporting portion 40, and the crankshaft stopper 50.

The motor portion 20 includes a stator 21, a rotor 22, and a crankshaft 23. The crankshaft 23 is press-fit into the rotor 22,and includes an eccentric portion 23*a*.

The compression device portion 30 includes a cylinder block 31 having a compressing chamber 31*a*, a piston 32 linearly reciprocating within the compressing chamber 31*a* of the cylinder block 31, and a connecting rod 33 disposed between the piston 32 and the eccentric portion 23*a* of the crankshaft 23. The connecting rod 33 transforms and transmits rotary movement of the crankshaft 23 into linear reciprocating movement of the piston 32.

The elastic supporting portion 40 absorbs and damps various vibrations produced during the operation of the compressor by elastically supporting the cylinder block 31 of the compression device portion 30 on the lower shell 12 of the sealed casing 10. The elastic supporting portion 40 includes a plurality of snubbers 41 arranged on the bottom surface of the lower shell 12, a plurality of protrusions 42 protruding from the lower portion of the cylinder block 31, and a plurality of suspension springs 43 disposed between the snubbers 41 and the protrusions 42 for elastically supporting the cylinder block 31.

The motor portion 20 and the compression device portion 30 can move vertically and horizontally during conveyance of the compressor into contact with the inner wall of the sealed casing 10. The crankshaft stopper 50 restricts movement of the motor portion 20 and the compression device portion 30, both of which are elastically supported within the sealed casing 10 by the elastic supporting portion 40. The crankshaft stopper 50 is welded onto the inner upper side of the upper shell 11 and has a movement restriction hole 51 for receiving the upper end of the crankshaft 23. Since the upper end of the crankshaft 23 is received and supported in the movement restriction hole 51 of the crankshaft stopper 50, movement of the motor portion 20 and the compression device portion 30 is limited. Accordingly, possible deformation and breakage of the components of the compressor due to wide vertical and horizontal movement of the electronic device portion 20 and the compression device portion 30 into contact with the inner wall of the sealed casing 10 can be prevented.

By partially increasing the rigidity of the sealed casing 10, the resonance reducer portion 60 reduces and/or prevents resonance of the sealed casing 10 that is caused by vibration produced during the operation of the compressor. Accordingly, transmission noise from the resonance of the sealed casing 10 can be reduced.

The resonance reducer portion 60 of the crankshaft stopper 50 may be formed in any of a number of different ways. In the preferred embodiment of the invention, the resonance reducer portion 60 is integrally formed with the crankshaft stopper 50 to achieve the highest efficiency with few changes to the existing components and no substantial modifications to the design of the compressor.

Figure 3A:
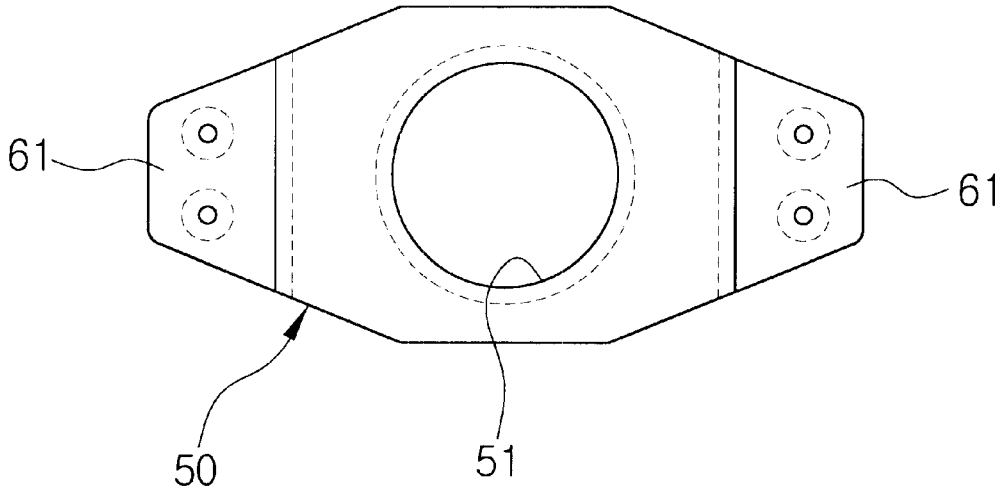
FIGS. 3A and 3B are plan and sectional views for showing the structure of a crankshaft stopper having the main feature of the present invention, i.e., a resonance reducer portion.
Figure 3B:
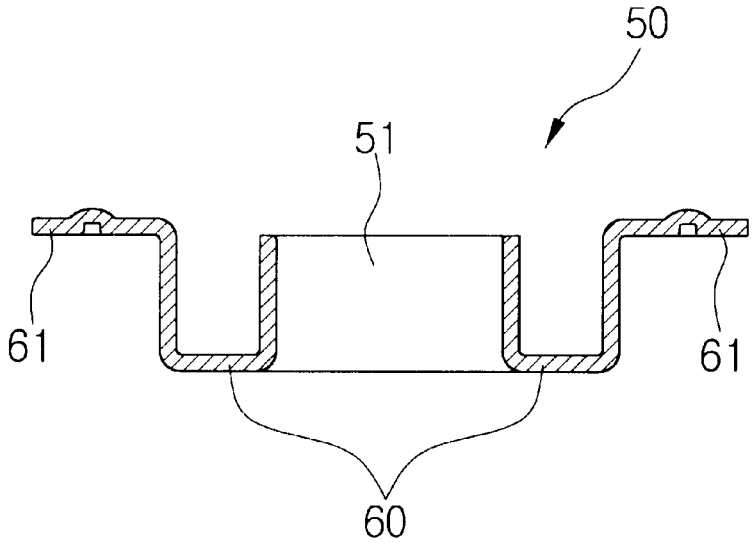

Regarding the crankshaft stopper 50 of the compressor according to the present invention, as shown in FIGS. 3A and 3B, the movement restriction hole 51, for receiving the upper end of the crankshaft 23, is formed in the center of the crankshaft stopper 50, and the resonance reducer portion 60 formed around the movement restriction hole 51 is bent. Further, welding portions 61 extend from the ends of the resonance reducer portion 60 for attaching the crankshaft stopper 50 to the inner upper side of the upper shell 11. For stronger adhesion, a plurality of embossings are formed on the welding portions 61. That is, in order to prevent the resonance of the sealed casing 10, the crankshaft stopper 50 adds mass to the upper shell 11 in addition to restricting movement of the crankshaft 23.

Figure 4:
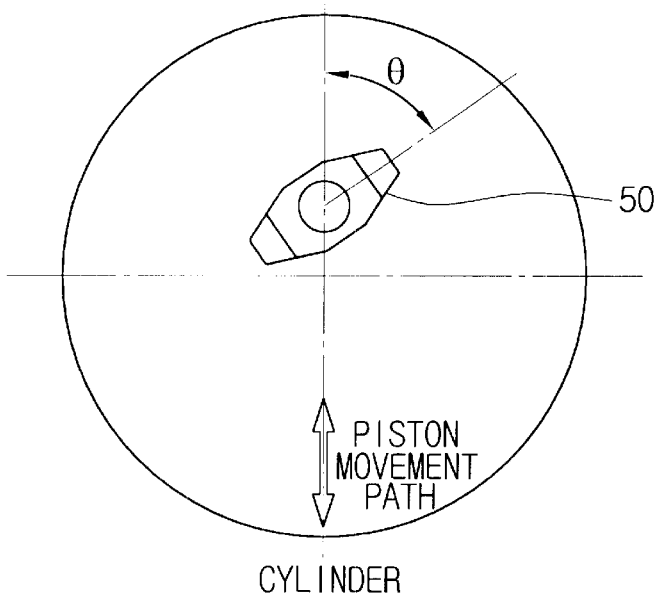
FIG. 4 is a view showing a preferred installation angle of the crankshaft stopper having the main feature of the present invention, i.e., the resonance reducer portion.

The crankshaft stopper 50 with the resonance reducer portion 60 is positioned at an offset by a certain angle away from the linear reciprocal movement path of the piston 32. The resonance level varies according to the angle between the crankshaft stopper 50 and the linear reciprocal movement path of the piston 32. According to experiment results as shown in FIG. 4, the greatest noise reduction is obtained by arranging the crankshaft stopper 50 at an angle of 45° from the linear reciprocal movement path of the piston 32. For example, the compressor having the crankshaft stopper 50 installed at the angle of 45° was employed in a refrigerator, and resulted in a substantial noise reduction in the low frequency range, i.e., 500 Hz, in which the resonance occurs in a refrigerator.

Albeit not shown, the mass increasing efficiency of the crankshaft stopper 50 can be further increased by various methods such as thickening the iron plate of the crankshaft stopper 50, or extending additional welding portions 61 from the resonance reducer portion 60 in the vertical direction of FIG. 3A in addition to the welding portions 61 which extend in a horizontal direction of FIG. 3A.

As described, in the hermetic reciprocating compressor according to the present invention, when electricity is supplied, rotary movement of the crankshaft 23 is transformed and transmitted to linear reciprocating movement of the piston 32 through the connecting rod 33. Accordingly, the piston 32 compresses and discharges a refrigerant in the compressing chamber 31*a* of the cylinder block 31. As described earlier, noise produced from the refrigerant flow is reduced by the suction and discharge mufflers 13 and 14, while various vibrations are absorbed and damped by the elastic supporting portion 40. Further, the resonance of the sealed casing 10 is damped and reduced by the resonance reducer portion 60 formed on the crankshaft stopper 50. Accordingly, transmission noise due to the resonance of the sealed casing 10 is reduced, and the noise from the compressor is reduced.

Table 1 below shows the experimental results, in which the compressor according to the present invention had 1–4 dB/A of noise reduction compared to the conventional compressor.

TABLE 1

| | | Conventional Compressor | Compressor (Present Invention) | Improvement (Noise Reduction) |
|---|---|---|---|---|
| Experiment 1 | 50 Hz | 48 dB/A | 45 dB/A | 3 dB/A |
| | 60 Hz | 48 dB/A | 44 dB/A | 4 dB/A |
| Experiment 2 | 50 Hz | 47.5 dB/A | 45 dB/A | 2.5 dB/A |
| | 60 Hz | 46 dB/A | 45 dB/A | 1 dB/A |

Figure 5:
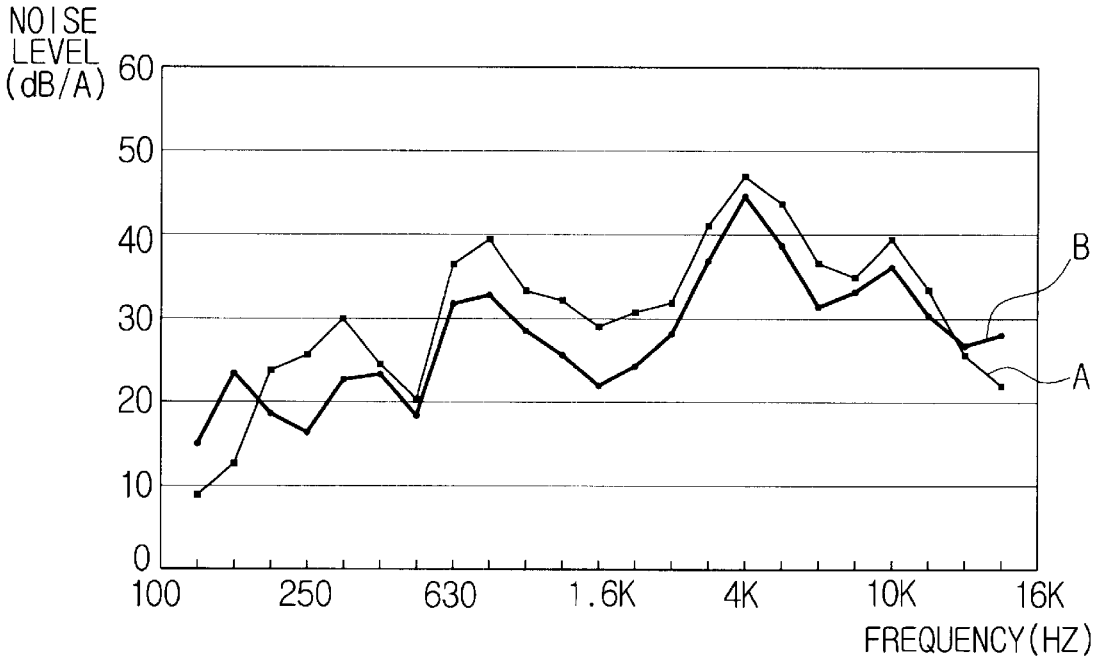
FIG. 5 is a graph showing the noise reduction efficiency of the hermetic reciprocating compressor according to the present invention, compared with the conventional hermetic reciprocating compressor.

Meanwhile, FIG. 5 is a graph for showing the noise reduction of the hermetic reciprocating compressor according to the present invention, when compared with the conventional hermetic reciprocating compressor. FIG. 5 shows the average value of noise measurements taken from the area ranging from high to low frequency regions at least four times. As shown in the graph, the average noise level B obtained from the compressor according to the present invention had 5–8 dB/A of noise reduction when compared to the average noise level A obtained from the conventional compressor.

As described above, according to the present invention, since the resonance of the sealed casing 10, which is produced by vibration of the compressor during operation, is greatly reduced or eliminated by the presence of the resonance reducer portion 60 on the crankshaft stopper 50, the noise from the compressor can be reduced. Accordingly, the quality of the compressor as well as the products employing the compressor is greatly increased.

As stated above, a preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A hermetic reciprocating compressor comprising:

a sealed casing having an upper shell and a lower shell;

a motor portion located in the sealed casing, the motor portion including a stator, a rotor, and a crankshaft;

a compression device portion coupled to the motor portion, the motor portion driving the compression device portion to compress and discharge a refrigerant;

elastic support means for absorbing and damping vibrations produced during operation of the compressor, the elastic support means elastically supporting the compression device portion on the lower shell of the sealed casing; and a crankshaft stopper attached to the upper shell of the sealed casing, the crankshaft stopper restricting movement of the motor portion and the compression device portion during conveyance of the compressor, the crankshaft stopper having an integrally formed resonance reducer portion, so as to reduce resonance of the sealed casing that is produced by vibration of the compressor during operation and the crankshaft stopper further having a centrally located movement restricting hole formed therein to receive an upper end of the crankshaft, the resonance reducer portion being formed around the movement restricting hole, the resonance reducer portion further including a plurality of welding portions for connecting the crankshaft stopper to the upper shell of the sealed casing.

2. The compressor as claimed in claim 1, wherein each welding portion includes a plurality of embossings formed thereon.

3. A hermetic reciprocating compressor comprising:

a sealed casing having an upper shell and a lower shell;

a motor portion located in the sealed casing, the motor portion including a stator, a rotor, and a crankshaft;

a compression device portion coupled to the motor portion, the motor portion driving the compression device portion to compress and discharge a refrigerant, the compression device portion including a cylinder block having a compression chamber, a piston reciprocally movable within the compression chamber of the cylinder block, and a connecting rod disposed between the piston and the crankshaft;

elastic support means for absorbing and damping vibrations produced during operation of the compressor, the elastic support means elastically supporting the cylinder block on the lower shell of the sealed casing; and a crankshaft stopper attached to an inner portion of the upper shell of the sealed casing, the crankshaft stopper restricting movement of the motor portion and the compression device portion during conveyance of the compressor, the crankshaft stopper having an integrally formed resonance reducer portion for reducing resonance of the sealed casing that is produced by vibration of the compressor during operation by increasing the rigidity of the sealed casing and the crankshaft stopper further having a centrally located movement restricting hole formed therein to receive an upper end of the crankshaft, said resonance reducer portion surrounding said restricting hole and further including at least two welding portions for connecting the crankshaft stopper to the upper shell of the sealed casing.

4. The compressor as claimed in claim 3, wherein each welding portion includes a plurality of embossings formed thereon.

5. The compressor as claimed in claim 3, wherein an axis of symmetry of the welding portions extending from the crankshaft stopper is offset at an angle form the reciprocal movement path of the piston.

6. The compressor as claimed in claim 5, wherein the angle is approximately 45°.

7. The compressor as claimed in claim 3, wherein the welding portions extend from the movement restricting hole in two directions spaced approximately 180 degrees apart.

8. The compressor as claimed in claim 7, wherein the principal angle of the crankshaft stopper is offset at an angle from the reciprocal movement path of the piston.

9. The compressor as claimed in claim 8, wherein the angle is approximately 45°.

* * * * *